US010397983B2

(12) United States Patent
Fortenbacher

(10) Patent No.: US 10,397,983 B2
(45) Date of Patent: Aug. 27, 2019

(54) WATER HEATING ELEMENTS

(71) Applicant: David Fortenbacher, Muskegon, MI (US)

(72) Inventor: David Fortenbacher, Muskegon, MI (US)

( * ) Notice: Subject to any disclaimer, the term of this patent is extended or adjusted under 35 U.S.C. 154(b) by 275 days.

(21) Appl. No.: 15/295,446

(22) Filed: Oct. 17, 2016

(65) Prior Publication Data

US 2018/0110097 A1 Apr. 19, 2018

(51) Int. Cl.

| | |
|---|---|
| ***H05B 3/78*** | (2006.01) |
| ***H05B 3/14*** | (2006.01) |
| ***H05B 3/06*** | (2006.01) |
| ***F24H 9/00*** | (2006.01) |
| *H05B 3/72* | (2006.01) |

(52) U.S. Cl.

CPC ..... *H05B 3/145* (2013.01); *F24H 9/0047* (2013.01); *H05B 3/06* (2013.01); *H05B 2203/021* (2013.01); *H05B 2214/04* (2013.01)

(58) Field of Classification Search

None

See application file for complete search history.

(56) References Cited

U.S. PATENT DOCUMENTS 3,890,486 A * 6/1975 Fitzgerald ..... A01K 63/065 119/245
6,541,744 B2 * 4/2003 Von Arx ..... A47J 36/2483 219/544
7,135,396 B1 * 11/2006 Gabriel ..... H01L 21/32136 438/612
2008/0166563 A1 * 7/2008 Brittingham ..... C08J 3/18 428/411.1
2009/0194525 A1 * 8/2009 Lee ..... H05B 3/145 219/553
2010/0126985 A1 * 5/2010 Feng ..... H05B 3/145 219/553
2010/0213189 A1 * 8/2010 Keite-Telgenbuescher ..... B60R 1/0602 219/548
2013/0089310 A1 * 4/2013 Wielstra ..... F22B 1/30 392/457
2014/0334807 A1 * 11/2014 Farris ..... F24H 9/2021 392/457
2015/0110478 A1 * 4/2015 Cardoso ..... F24H 9/0021 392/452
2015/0366005 A1 * 12/2015 Janas ..... H05B 3/145 219/541
2016/0119977 A1 * 4/2016 Caldeira ..... H05B 3/145 219/539
2016/0169824 A1 * 6/2016 Shin ..... G01N 27/125 73/31.06
2017/0219294 A1 * 8/2017 Longis ..... F24H 7/0216
2018/0171849 A1 * 6/2018 Saupe ..... F01N 3/206
2019/0032827 A1 * 1/2019 Lotfi ..... F16L 37/08

* cited by examiner

*Primary Examiner* — Joseph M Pelham

(74) *Attorney, Agent, or Firm* — James E. Shultz, Jr.

(57) ABSTRACT

Water heating elements are provided that include carbon nanotubes. A water heating element may be a wrap-around configuration or an immersion device.

13 Claims, 6 Drawing Sheets

WATER HEATING ELEMENTS

TECHNICAL FIELD

The present disclosure relates to water heating elements. More particularly, the present disclosure relates to water heating elements that include carbon nanotubes.

BACKGROUND

Heating elements are incorporated proximate water tanks and/or pipes to heat liquids and/or gasses contained with and/or flowing through the tanks and/or pipes. Deterioration of the heating elements may be caused due to cyclical heating/cooling and/or due to exposure to the liquids and/or gasses.

In view of the above, water heating elements are needed that include carbon nanotubes.

SUMMARY

A wrap-around water heating element may include a carbon nanotube composite. The wrap-around water heating element may further include a positive electrical connection and a negative electrical connection, wherein the positive electrical connection and the negative electrical connection are configured to connect the carbon nanotube composite to an electric power source.

In another embodiment, a water heating element may include a carbon nanotube composite. The water heating element may further include a positive electrical connection and a negative electrical connection, wherein the positive electrical connection and the negative electrical connection are configured to connect the carbon nanotube composite to an electric power source.

In a further embodiment, an immersion electric water heating element for operation in an electric water heater may include a carbon nanotube composite. The immersion electric water heating element may further include a positive electrical connection and a negative electrical connection, wherein the positive electrical connection and the negative electrical connection are configured to connect the carbon nanotube composite to an electric power source.

DETAIL DESCRIPTION

Figure 1A:
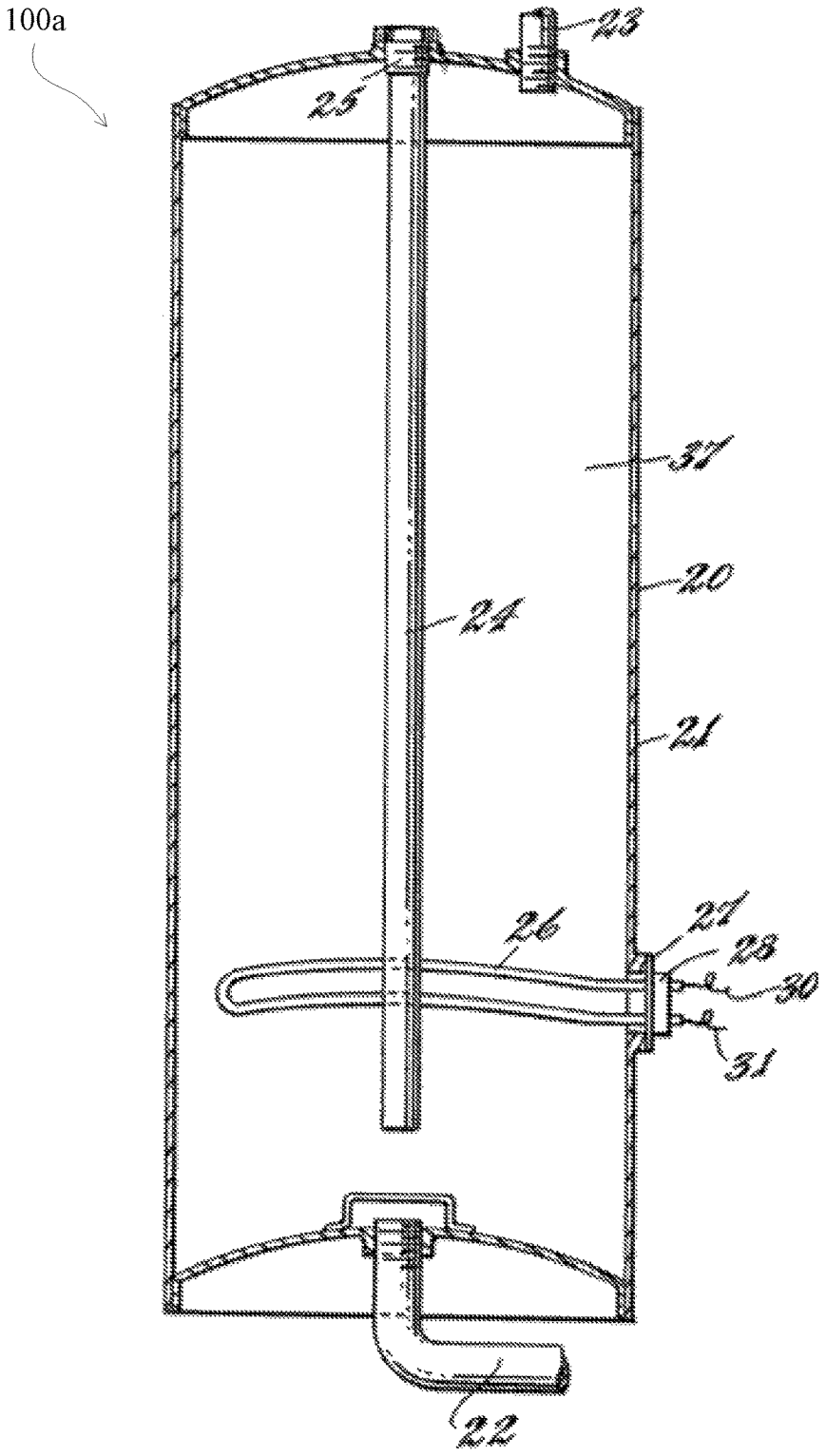
FIGS. 1A and 1B depict an example water heating element.

Heating elements are provided that include carbon nanotubes. A heating element may be a wrap-around configuration or an immersion device. The heating elements may be used to heat liquids (e.g., water, oil, gasoline, diesel fuel, etc.) and/or gasses (e.g., natural gas, propane, ammonia, ammonium, etc.) within a tank and/or flowing through a pipe.

A nanoparticle composite may include a structure as disclosed, for example, in any one of U.S. Pat. No. 9,377,449, entitled Nanocomposite oil sensors for downhole hydrocarbon detection; U.S. Pat. No. 9,372,151, entitled Cross antennas for surface-enhanced infrared absorption (SERA) spectroscopy of chemical moieties; U.S. Pat. No. 9,358,730, entitled Dynamic strain hardening in polymer nanocomposites; U.S. Pat. No. 9,356,151, entitled Fabrication of graphene nanoribbons and nanowires using a meniscus as an etch mask; U.S. Pat. No. 9,340,894, entitled Anode battery materials and methods of making the same; U.S. Pat. No. 9,321,021, entitled Converting nanoparticles in oil to aqueous suspensions; U.S. Pat. No. 9,312,540, entitled Conformal coating on nanostructured electrode materials for three-dimensional applications; U.S. Pat. No. 9,312,078, entitled Patterned graphite oxide films and methods to make and use same; U.S. Pat. No. 9,290,665, entitled Coated fullerenes, compositions and dielectrics made therefrom; U.S. Pat. No. 9,283,511, entitled Composite materials for reversible CO.sub.2 capture; U.S. Pat. No. 9,260,570, entitled Compression induced stiffening and alignment of liquid crystal elastomers; U.S. Pat. No. 9,255,853, entitled Non-contact strain sensing of objects by use of single-walled carbon nanotubes; U.S. Pat. No. 9,249,023, entitled Liquid crystals from single-walled carbon nanotube polyelectrolytes and their use for making various materials; U.S. Pat. No. 9,228,009, entitled Multi-hierarchical self-assembly of a collagen mimetic peptide; U.S. Pat. No. 9,222,665, entitled Waste remediation; U.S. Pat. No. 9,202,952, entitled Plasmon induced hot carrier device, method for using the same, and method for manufacturing the same; U.S. Pat. No. 9,129,720, entitled Synthesis of uniform nanoparticle shapes with high selectivity; U.S. Pat. No. 9,106,342, entitled Device and method for modulating transmission of terahertz waves; U.S. Pat. No. 9,096,437, entitled Growth of graphene films from non-gaseous carbon sources; U.S. Pat. No. 9,095,876, entitled Immobilized carbon nanotubes on various surfaces; U.S. Pat. No. 9,068,109, entitled Nano-encapsulated triggered-release viscosity breaker; U.S. Pat. No. 9,067,791, entitled Embedded arrays of vertically aligned carbon nanotube carpets and methods for making them; U.S. Pat. No. 9,061,268, entitled Synthesis of ultrasmall metal oxide nanoparticles; U.S. Pat. No. 9,034,085, entitled Aliphatic amine based nanocarbons for the absorption of carbon dioxide; U.S. Pat. No. 9,032,731, entitled Cooling systems and hybrid A/C systems using an electromagnetic radiation-absorbing complex; U.S. Pat. No. 9,005,460, entitled Layer-by-layer removal of grapheme; U.S. Pat. No. 8,992,881, entitled Graphene nanoribbons prepared from carbon nanotubes via alkali metal exposure; U.S. Pat. No. 8,986,942, entitled Carbon nanotube based imaging agents; U.S. Pat. No. 8,958,362, entitled Method and system for wirelessly transmitting data; U.S. Pat. No. 8,956,440, entitled High-yield synthesis of gold nanorods with optical absorption at wavelengths greater than 1000 nm using hydroquinone; U.S. Pat. No. 8,916,606, entitled Therapeutic compositions and methods for targeted delivery of active agents; U.S. Pat. No. 8,906,984, entitled Synthesis of metal and metal oxide nanoparticle-embedded siloxane composites; U.S. Pat. No. 8,816,042, entitled Polyamide composites having flexible spacers; U.S. Pat. No. 8,815,231, entitled Systems and methods for magnetic guidance and patterning of materials; U.S. Pat. No. 8,809,979, entitled Functionalized carbon nanotube-polymer composites and interactions with radiation; U.S. Pat. No. 8,784,866, entitled Water-soluble carbon nanotube compositions for drug delivery and medicinal applications; U.S. Pat. No. 8,732,468, entitled Protecting hardware circuit design by secret sharing; U.S. Pat. No. 8,709,373, entitled Strongly bound carbon nanotube arrays directly grown on substrates and methods for production thereof; U.S. Pat. No. 8,703,090, entitled Methods for preparation of graphene nanoribbons from carbon nanotubes and compositions, thin films and devices derived therefrom; U.S. Pat. No. 8,679,442, entitled Fullerene compositions and methods for photochemical purification; U.S. Pat. No. 8,663,690, entitled Method for nanoencapsulation; U.S. Pat. No. 8,663,495, entitled Gelled nanotube-containing heat transfer medium; U.S. Pat. No. 8,636,830, entitled Aliphatic amine based nanocarbons for the absorption of carbon dioxide; U.S. Pat. No. 8,596,466, entitled Production of single-walled carbon nanotube grids; U.S. Pat. No. 8,591,854, entitled Methods for solubilizing and separating large fullerenes; U.S. Pat. No. 8,575,548, entitled Analyzing the transport of plasmonic particles through mineral formations; U.S. Pat. No. 8,562,935, entitled Amplification of carbon nanotubes via seeded-growth methods; U.S. Pat. No. 8,541,322, entitled Sidewall functionalization of carbon nanotubes with organosilanes for polymer composites; U.S. Pat. No. 8,540,959, entitled Bulk cutting of carbon nanotubes using electron beam irradiation; U.S. Pat. No. 8,460,428, entitled Single-crystalline metal nanorings and methods for synthesis thereof; U.S. Pat. No. 8,449,854, entitled Method for preparation of new superhard B—C—N material and material made therefrom; U.S. Pat. No. 8,440,467, entitled Electronic switching, memory, and sensor devices from a discontinuous graphene and/or graphite carbon layer on dielectric materials; U.S. Pat. No. 8,420,717, entitled Polyol functionalized water soluble carbon nanostructures; U.S. Pat. No. 8,398,950, entitled Condensation polymers having covalently bound carbon nanotubes; U.S. Pat. No. 8,395,901, entitled Vertically-stacked electronic devices having conductive carbon films; U.S. Pat. No. 8,394,664, entitled Electrical device fabrication from nanotube formations; U.S. Pat. No. 8,390,326, entitled Method for fabrication of a semiconductor element and structure thereof; U.S. Pat. No. 8,362,559, entitled Hybrid molecular electronic devices containing molecule-functionalized surfaces for switching, memory, and sensor applications and methods for fabricating same; U.S. Pat. No. 8,362,295, entitled Graphene compositions and methods for production thereof; U.S. Pat. No. 8,361,349, entitled Fabrication of light emitting film coated fullerenes and their application for in-vivo light emission; U.S. Pat. No. 8,337,809, entitled Charge-assembled capsules for phototherapy; U.S. Pat. No. 8,310,134, entitled Composition for energy generator, storage, and strain sensor and methods of use thereof; U.S. Pat. No. 8,269,501, entitled Methods for magnetic imaging of geological structures; U.S. Pat. No. 8,236,491, entitled Protein fragment complementation assay for thermophiles; U.S. Pat. No. 8,223,330, entitled Nanostructures and lithographic method for producing highly sensitive substrates for surface-enhanced spectroscopy; U.S. Pat. No. 8,217,137, entitled Fullerene-based amino acids; U.S. Pat. No. 8,201,517, entitled Method for low temperature growth of inorganic materials from solution using catalyzed growth and re-growth; U.S. Pat. No. 8,187,703, entitled Fiber-reinforced polymer composites containing functionalized carbon nanotubes; U.S. Pat. No. 8,183,180, entitled Graphene compositions and drilling fluids derived therefrom; U.S. Pat. No. 8,178,202, entitled Nonconcentric nano shells with offset core in relation to shell and method of using the same; U.S. Pat. No. 8,158,203, entitled Methods of attaching or grafting carbon nanotubes to silicon surfaces and composite structures derived therefrom; U.S. Pat. No. 8,128,901, entitled Facile purification of carbon nanotubes with liquid bromine at room temperature; U.S. Pat. No. 8,124,503, entitled Carbon nanotube diameter selection by pretreatment of metal catalysts on surfaces; U.S. Pat. No. 8,106,430, entitled Preparation of thin film transistors (TFTs) or radio frequency identification (RFID) tags or other printable electronics using ink-jet printer and carbon nanotube inks; U.S. Pat. No. 8,097,141, entitled Flow dielectrophoretic separation of single wall carbon nanotubes; U.S. Pat. No. 8,092,774, entitled Nanotube-amino acids and methods for preparing same; U.S. Pat. No. 8,089,628, entitled Pulsed-multiline excitation for color-blind fluorescence detection; U.S. Pat. No. 8,080,199, entitled Interaction of microwaves with carbon nanotubes to facilitate modification; U.S. Pat. No. 8,062,748, entitled Methods for preparing carbon nanotube/polymer composites using free radical precursors; U.S. Pat. No. 8,062,702, entitled Coated fullerenes, composites and dielectrics made therefrom; U.S. Pat. No. 8,058,613, entitled Micromechanical devices for materials characterization; U.S. Pat. No. 8,045,152, entitled All optical nanoscale sensor; U.S. Pat. No. 8,007,829, entitled Method to fabricate inhomogeneous particles; U.S. Pat. No. 8,003,215, entitled Fluorinated nanodiamond as a precursor for solid substrate surface coating using wet chemistry; U.S. Pat. No. 7,998,271, entitled Solvents and new method for the synthesis of CdSe semiconductor nanocrystals; U.S. Pat. No. 7,976,816, entitled Method for functionalizating carbon naontubes utilizing peroxides; U.S. Pat. No. 7,973,559, entitled Method for fabrication of a semiconductor element and structure thereof; U.S. Pat. No. 7,959,779, entitled Macroscopically manipulable nanoscale devices made from nanotube assemblies; U.S. Pat. No. 7,940,043, entitled NMR method of detecting precipitants in a hydrocarbon stream; U.S. Pat. No. 7,939,136, entitled Method for forming composites of sub-arrays of fullerene nanotubes; U.S. Pat. No. 7,939,047, entitled Bulk separation of carbon nanotubes by bandgap; U.S. Pat. No. 7,938,991, entitled Polymer/carbon-nanotube interpenetrating networks and process for making same; U.S. Pat. No. 7,938,969, entitled Magnetic purification of a sample; U.S. Pat. No. 7,893,513, entitled Nanoparticle/nanotube-based nanoelectronic devices and chemically-directed assembly thereof; U.S. Pat. No. 7,887,774, entitled Methods for selective functionalization and separation of carbon nanotubes; U.S. Pat. No. 7,879,940, entitled Polymerization initated at sidewalls of carbon nanotubes; U.S. Pat. No. 7,858,186, entitled Fluorinated nanodiamond as a precursor for solid substrate surface coating using wet chemistry; U.S. Pat. No. 7,838,077, entitled Functionalized, hydrogen-passivated silicon surfaces; U.S. Pat. No. 7,829,119, entitled Method to fabricate microcapsules from polymers and charged nanoparticles; U.S. Pat. No. 7,825,064, entitled Supported catalysts using nanoparticles as the support material; U.S. Pat. No. 7,821,079, entitled Preparation of thin film transistors (TFTs) or radio frequency identification (RFID) tags or other printable electronics using ink-jet printer and carbon nanotube inks; U.S. Pat. No. 7,820,130, entitled Functionalization of nanodiamond powder through fluorination and subsequent derivatization reactions; U.S. Pat. No. 7,790,066, entitled Nanorice particles: hybrid plasmonic nano structures; U.S. Pat. No. 7,758,841, entitled Reductive functionalization of carbon nanotubes; U.S. Pat. No. 7,744,844, entitled Functionalized carbon nanotube-polymer composites and interactions with radiation; U.S. Pat. No. 7,740,826, entitled Method for functionalizing carbon nanotubes utilizing peroxides; U.S. Pat. No. 7,730,547, entitled Smart materials: strain sensing and stress determination by means of nanotube sensing systems, composites, and devices; U.S. Pat. No. 7,727,504, entitled Fibers comprised of epitaxially grown single-wall carbon nanotubes, and a method for added catalyst and continuous growth at the tip; U.S. Pat. No. 7,718,550, entitled Method for low temperature growth of inorganic materials from solution using catalyzed growth and re-growth; U.S. Pat. No. 7,692,218, entitled Method for creating a functional interface between a nanoparticle, nanotube or nanowire, and a biological molecule or system; U.S. Pat. No. 7,682,527, entitled Fabrication of light emitting film coated fullerenes and their application for in-vivo light emission; U.S. Pat. No. 7,682,523, entitled Fluorescent security ink using carbon nanotubes; U.S. Pat. No. 7,670,583, entitled Multi-step purification of single-wall carbon nanotubes; U.S. Pat. No. 7,655,302, entitled Continuous fiber of fullerene nanotubes; U.S. Pat. No. 7,632,569, entitled Array of fullerene nanotubes; U.S. Pat. No. 7,632,481, entitled Sidewall functionalization of nanotubes with hydroxyl terminated moieties; U.S. Pat. No. 7,601,421, entitled Fabrication of carbon nanotube reinforced epoxy polymer composites using functionalized carbon nanotubes; U.S. Pat. No. 7,585,420, entitled Carbon nanotube substrates and catalyzed hot stamp for polishing and patterning the substrates; U.S. Pat. No. 7,578,941, entitled Length-based liquid-liquid extraction of carbon nanotubes using a phase transfer catalyst; U.S. Pat. No. 7,572,426, entitled Selective functionalization of carbon nanotubes; U.S. Pat. No. 7,527,831, entitled Method of making a molecule-surface interface; U.S. Pat. No. 7,511,811, entitled Pulsed-multiline excitation for color-blind fluorescence detection; U.S. Pat. No. 7,510,695, entitled Method for forming a patterned array of fullerene nanotubes; U.S. Pat. No. 7,494,639, entitled Purification of carbon nanotubes based on the chemistry of fenton's reagent; U.S. Pat. No. 7,481,989, entitled Method for cutting fullerene nanotubes; U.S. Pat. No. 7,470,417, entitled Ozonation of carbon nanotubes in fluorocarbons; U.S. Pat. No. 7,452,519, entitled Sidewall functionalization of single-wall carbon nanotubes through C—N bond forming substitutions of fluoronanotubes; U.S. Pat. No. 7,419,651, entitled Method for producing self-assembled objects comprising fullerene nanotubes and compositions thereof; U.S. Pat. No. 7,419,624, entitled Methods for producing composites of fullerene nanotubes and compositions thereof; U.S. Pat. No. 7,407,640, entitled Functionalized carbon nanotube-polymer composites and interactions with radiation; U.S. Pat. No. 7,390,767, entitled Method for producing a catalyst support and compositions thereof; U.S. Pat. No. 7,390,477, entitled Fullerene nanotube compositions; U.S. Pat. No. 7,361,369, entitled Implant with structure allowing injection of polymer for attaching implant to tissue; U.S. Pat. No. 7,357,906, entitled Method for fractionating single-wall carbon nanotubes; U.S. Pat. No. 7,354,563, entitled Method for purification of as-produced fullerene nanotubes; U.S. Pat. No. 7,324,215, entitled Non-destructive optical imaging system for enhanced lateral resolution; U.S. Pat. No. 7,323,136, entitled Containerless mixing of metals and polymers with fullerenes and nanofibers to produce reinforced advanced materials; U.S. Pat. No. 7,306,828, entitled Fabrication of reinforced composite material comprising carbon nanotubes, fullerenes, and vapor-grown carbon fibers for thermal barrier materials, structural ceramics, and multifunctional nanocomposite ceramics; U.S. Pat. No. 7,264,876, entitled Polymer-wrapped single wall carbon nanotubes; U.S. Pat. No. 7,262,266, entitled Copolymerization of polybenzazoles and other aromatic polymers with carbon nanotubes; U.S. Pat. No. 7,253,014, entitled Fabrication of light emitting film coated fullerenes and their application for in-vivo light emission; U.S. Pat. No. 7,205,069, entitled Membrane comprising an array of single-wall carbon nanotubes; U.S. Pat. No. 7,204,970, entitled Single-wall carbon nanotubes from high pressure CO; U.S. Pat. No. 7,176,146, entitled Method of making a molecule-surface interface; U.S. Pat. No. 7,125,533, entitled Method for functionalizing carbon nanotubes utilizing peroxides; U.S. Pat. No. 7,115,864, entitled Method for purification of as-produced single-wall carbon nanotubes; U.S. Pat. No. 7,108,841, entitled Method for forming a patterned array of single-wall carbon nanotubes; U.S. Pat. No. 7,105,596, entitled Methods for producing composites of single-wall carbon nanotubes and compositions thereof; U.S. Pat. No. 7,097,820, entitled Continuous fiber of single-wall carbon nanotubes; U.S. Pat. No. 7,087,207, entitled Method for forming an array of single-wall carbon nanotubes in an electric field and compositions thereof; U.S. Pat. No. 7,071,406, entitled Array of single-wall carbon nanotubes; U.S. Pat. No. 7,067,098, entitled Method for forming an array of single-wall carbon nanotubes and compositions thereof; U.S. Pat. No. 7,052,666, entitled Method for cutting single-wall carbon nanotubes; U.S. Pat. No. 7,048,999, entitled Method for producing self-assembled objects comprising single-wall carbon nanotubes and compositions thereof; U.S. Pat. No. 7,048,903, entitled Macroscopically manipulable nanoscale devices made from nanotube assemblies; U.S. Pat. No. 7,041,620, entitled Method for producing a catalyst support and compositions thereof; U.S. Pat. No. 7,029,646, entitled Method for cutting single-wall carbon nanotubes through fluorination; U.S. Pat. No. 7,008,604, entitled Method for cutting nanotubes; U.S. Pat. No. 7,008,563, entitled Polymer-wrapped single wall carbon nanotubes; U.S. Pat. No. 6,995,841, entitled Pulsed-multiline excitation for color-blind fluorescence detection; U.S. Pat. No. 6,986,876, entitled Method for forming composites of sub-arrays of single-wall carbon nanotubes; U.S. Pat. No. 6,979,709, entitled Continuous fiber of single-wall carbon nanotubes; U.S. Pat. No. 6,949,237, entitled Method for growing single-wall carbon nanotubes utlizing seed molecules; U.S. Pat. No. 6,939,525, entitled Method of forming composite arrays of single-wall carbon nanotubes and compositions thereof; U.S. Pat. No. 6,936,306, entitled Chemical control over ceramic porosity using carboxylate-alumoxanes; U.S. Pat. No. 6,936,233, entitled Method for purification of as-produced single-wall carbon nanotubes; U.S. Pat. No. 6,875,475, entitled Methods for producing submicron metal line and island arrays; U.S. Pat. No. 6,824,755, entitled Method for producing a catalyst support and compositions thereof; U.S. Pat. No. 6,778,316, entitled Nanoparticle-based all-optical sensors; U.S. Pat. No. 6,761,870, entitled Gas-phase nucleation and growth of single-wall carbon nanotubes from high pressure CO; U.S. Pat. No. 6,756,026, entitled Method for growing continuous carbon fiber and compositions thereof; U.S. Pat. No. 6,756,025, entitled Method for growing single-wall carbon nanotubes utilizing seed molecules; U.S. Pat. No. 6,749,827, entitled Method for growing continuous fiber; U.S. Pat. No. 6,683,783, entitled Carbon fibers formed from single-wall carbon nanotubes; U.S. Pat. No. 6,428,762, entitled Powder synthesis and characterization of amorphous carbon nitride, a-C3N4; U.S. Pat. No. 6,369,183, entitled Methods and materials for fabrication of alumoxane polymers; U.S. Pat. No. 6,322,890, entitled Supra-molecular alkylalumoxanes; U.S. Pat. No. 6,124,373, entitled Bone replacement compound comprising poly(polypropylene fumarate); U.S. Pat.

No. 6,018,390, entitled Integrated optics waveguide accelerometer with a proof mass adapted to exert force against the optical waveguide during acceleration; or U.S. Patent Application Publication Nos.: 20160163652, entitled COATED FULLERENES, COMPOSITES AND DIELECTRICS MADE THEREFROM; 20160153098, entitled SELF-IMPROVING ELECTROCATALYSTS FOR GAS EVOLUTION REACTIONS; 20160137875, entitled CONDUCTIVE POLYMER COATING COMPOSITION; 20160131637, entitled SUSPENDED NANO-ELECTRODES FOR ON-CHIP ELECTROPHYSIOLOGY; 20160068690, entitled CARBON NANOTUBE COATING COMPOSITION; 20160002673, entitled SOLAR STEAM PROCESSING OF BIOFUEL FEEDSTOCK AND SOLAR DISTILLATION OF BIOFUELS; 20150368539, entitled CARBONACEOUS NANOPARTICLES AS CONDUCTIVITY ENHANCEMENT ADDITIVES TO WATER-IN-OIL EMULSIONS, OIL-IN-WATER EMULSIONS AND OIL-BASED WELLBORE FLUIDS; 20150360956, entitled PRODUCTION OF GRAPHENE NANOPLATELETS BY OXIDATIVE ANHYDROUS ACIDIC MEDIA; 20150307357, entitled PRODUCTION OF GRAPHENE NANORIBBONS BY OXIDATIVE ANHYDROUS ACIDIC MEDIA; 20150298164, entitled CARBON NANOTUBE FILMS PROCESSED FROM STRONG ACID SOLUTIONS AND METHODS FOR PRODUCTION THEREOF; 20150280248, entitled GRAPHENE QUANTUM DOT-CARBON MATERIAL COMPOSITES AND THEIR USE AS ELECTROCATALYSTS; 20150216975, entitled NANOVECTOR BASED DRUG DELIVERY SYSTEM FOR OVERCOMING DRUG RESISTANCE; 20150162381, entitled ADDRESSABLE SIOX MEMORY ARRAY WITH INCORPORATED DIODES; 20150108391, entitled SYNTHESIS OF MAGNETIC CARBON NANORIBBONS AND MAGNETIC FUNCTIONALIZED CARBON NANORIBBONS; 20150023858, entitled REBAR HYBRID MATERIALS AND METHODS OF MAKING THE SAME; 20140367091, entitled WELLBORE FLUIDS INCORPORATING MAGNETIC CARBON NANORIBBONS AND MAGNETIC FUNCTIONALIZED CARBON NANORIBBONS AND METHODS OF USING THE SAME; 20140363669, entitled CARBON NANOTUBES FIBER HAVING LOW RESISTIVITY, HIGH MODULUS AND/OR HIGH THERMAL CONDUCTIVITY AND A METHOD OF PREPARING SUCH FIBERS BY SPINNING USING A FIBER SPIN-DOPE; 20140357534, entitled METHODS, APPARATUS, AND SENSORS FOR TRACING FRAC FLUIDS IN MINERAL FORMATIONS, PRODUCTION WATERS, AND THE ENVIRONMENT USING MAGNETIC PARTICLES; 20140313636, entitled GRAPHENE-CARBON NANOTUBE HYBRID MATERIALS AND USE AS ELECTRODES; 20140255291, entitled LIQUID CRYSTALS FROM SINGLE-WALLED CARBON NANOTUBE POLYELECTROLYTES AND THEIR USE FOR MAKING VARIOUS MATERIALS; 20140193711, entitled COMBINED ELECTROCHEMICAL AND CHEMICAL ETCHING PROCESSES FOR GENERATION OF POROUS SILICON PARTICULATES; 20140187651, entitled MULTI-HIERARCHICAL SELF-ASSEMBLY OF A COLLAGEN MIMETIC PEPTIDE; 20140178688, entitled BERNAL-STACKED GRAPHENE LAYERS AND METHODS OF MAKING THE SAME; 20140154269, entitled TARGETED NANOVECTORS AND THEIR USE FOR TREATMENT OF BRAIN TUMORS; 20140141224, entitled FABRICATION OF CARBON FOAMS THROUGH SOLUTION PROCESSING IN SUPERACIDS; 20140120453, entitled PATTERNED GRAPHITE OXIDE FILMS AND METHODS TO MAKE AND USE SAME; 20140120167, entitled MULTIFUNCTIONAL CHEMO- AND MECHANICAL THERAPEUTICS; 20140120081, entitled USE OF CARBON NANOMATERIALS WITH ANTIOXIDANT PROPERTIES TO TREAT OXIDATIVE STRESS; 20140103255, entitled ALIPHATIC AMINE BASED NANOCARBONS FOR THE ABSORPTION OF CARBON DIOXIDE; 20140097842, entitled ELECTRON SPIN RESONANCE FOR MEDICAL IMAGING; 20140094391, entitled BIO-NANO-CHIPS FOR ON-SITE DRUG SCREENING; 20140084219, entitled DOPED MULTIWALLED CARBON NANOTUBE FIBERS AND METHODS OF MAKING THE SAME; 20140081067, entitled SORPTION AND SEPARATION OF VARIOUS MATERIALS BY GRAPHENE OXIDES; 20140077138, entitled BORON NITRIDE-BASED FLUID COMPOSITIONS AND METHODS OF MAKING THE SAME; 20140048748, entitled GRAPHENE NANORIBBON COMPOSITES AND METHODS OF MAKING THE SAME; 20140014030, entitled METHODS FOR PRODUCTION OF SINGLE-CRYSTAL GRAPHENES; 20140011034, entitled GRAPHITE OXIDE COATED PARTICULATE MATERIAL AND USES THEREOF; 20130345099, entitled Nano-Encapsulated Triggered-Release Viscosity Breaker; 20130334104, entitled DISTILLING A CHEMICAL MIXTURE USING AN ELECTROMAGNETIC RADIATION-ABSORBING COMPLEX FOR HEATING; 20130319973, entitled LAYER-BY-LAYER REMOVAL OF GRAPHENE; 20130306463, entitled PURIFYING A FLUID USING A HEAT CARRIER COMPRISING AN ELECTROMAGNETIC RADIATION-ABSORBING COMPLEX; 20130299933, entitled PLASMON INDUCED HOT CARRIER DEVICE, METHOD FOR USING THE SAME, AND METHOD FOR MANUFACTURING THE SAME; 20130295580, entitled ORAL CANCER POINT OF CARE DIAGNOSTICS; 20130274136, entitled PROSTATE CANCER POINT OF CARE DIAGNOSTICS; 20130264121, entitled GRAPHENE-BASED MATERIAL FOR SHALE STABILIZATION AND METHOD OF USE; 20130190472, entitled POLYAMIDE COMPOSITES HAVING FLEXIBLE SPACERS; 20130168543, entitled ANALYZING THE TRANSPORT OF PLASMONIC PARTICLES THROUGH MINERAL FORMATIONS; 20130130933, entitled BIOMARKER SIGNATURES FOR WELLNESS TESTING; 20130108826, entitled PRODUCTION OF HIGHLY CONDUCTIVE CARBON NANOTUBE-POLYMER COMPOSITES; 20130095314, entitled IMMOBILIZED CARBON NANOTUBES ON VARIOUS SURFACES; 20130090511, entitled SYNTHESIS OF ULTRASMALL METAL OXIDE NANOPARTICLES; 20130069271, entitled DYNAMIC STRAIN HARDENING IN POLYMER NANOCOMPOSITES; 20130048339, entitled TRANSPARENT ELECTRODES BASED ON GRAPHENE AND GRID HYBRID STRUCTURES; 20130045420, entitled ANODE BATTERY MATERIALS AND METHODS OF MAKING THE SAME; 20130017453, entitled Conformal Coating On Nanostructured Electrode Materials For Three-Dimensional Applications; 20120302816, entitled THERAPEUTIC COMPOSITIONS AND METHODS FOR TARGETED DELIVERY OF ACTIVE AGENTS; 20120267893, entitled ELECTRICITY GENERATION USING ELECTROMAGNETIC RADIATION; 20120238021, entitled METHODS OF SYNTHESIZING THREE-DIMENSIONAL HETEROATOM-DOPED CARBON NANOTUBE MACRO MATERIALS AND COMPOSITIONS THEREOF; 20120231326, entitled STRUCTURED SILICON BATTERY ANODES; 20120213994, entitled X-RAY ABSORBING COMPOSITIONS AND METHODS OF MAKING THE SAME; 20120208008, entitled GRAPHENE-BASED THIN FILMS IN HEAT CIRCUITS AND METHODS OF MAKING THE SAME; 20120189492, entitled FULLERENE COMPOSITIONS AND METHODS FOR PHOTOCHEMICAL PURIFICATION; 20120156102, entitled WASTE REMEDIATION; 20120155841, entitled GENERATING A HEATED FLUID USING AN ELECTROMAGNETIC RADIATION-ABSORBING COMPLEX; 20120153621, entitled COOLING SYSTEMS AND HYBRID A/C SYSTEMS USING AN ELECTROMAGNETIC RADIATION-ABSORBING COMPLEX; 20120119162, entitled Coated Fullerenes, Compositions And Dielectrics Made Therefrom; 20120090816, entitled SYSTEMS AND METHODS FOR HEAT TRANSFER UTILIZING HEAT EXCHANGERS WITH CARBON NANOTUBES; 20120024153, entitled ALIPHATIC AMINE BASED NANOCARBONS FOR THE ABSORPTION OF CARBON DIOXIDE; 20110318248, entitled Methods for Solubilizing and Separating Large Fullerenes; 20110311427, entitled Strongly Bound Carbon Nanotube Arrays Directly Grown On Substrates And Methods For Production Thereof; 20110287462, entitled PROTEIN FRAGMENT COMPLEMENTATION ASSAY FOR THERMOPHILES; 20110274624, entitled CONTRAST AGENTS IN POROUS PARTICLES; 20110220839, entitled CONVERTING NANOPARTICLES IN OIL TO AQUEOUS SUSPENSIONS; 20110213288, entitled Device And Method For Transfecting Cells For Therapeutic Uses; 20110201764, entitled POLYMER/CARBON-NANOTUBE INTERPENETRATING NETWORKS AND PROCESS FOR MAKING SAME; 20110086781, entitled METHOD FOR FORMING COMPOSITES OF SUB-ARRAYS OF FULLERENE NANOTUBES; 20110079770, entitled Preparation of Thin Film Transistors (TFTs) or Radio Frequency Identification (RFID) Tags or Other Printable Electronics Using Ink-Jet Printer and Carbon Nanotube Inks; 20110065946, entitled FLUORINATED NANODIAMOND AS A PRECURSOR FOR SOLID SUBSTRATE SURFACE COATING USING WET CHEMISTRY; 20110032511, entitled SYSTEM AND METHOD TO MEASURE NANO-SCALE STRESS AND STRAIN IN MATERIALS; 20100317820, entitled Polyol Functionalized Water Soluble Carbon Nanostructures; 20100303913, entitled Method for Nanoencapsulation; 20100294976, entitled COMPOSITION FOR ENERGY GENERATOR, STORAGE, AND STRAIN SENSOR AND METHODS OF USE THEREOF; 20100289524, entitled Method for Fabrication of a Semiconductor Element and Structure Thereof; 20100287374, entitled Protecting Hardware Circuit Design by Secret Sharing; 20100284898, entitled BULK CUTTING OF CARBON NANOTUBES USING ELECTRON BEAM IRRADIATION; 20100284156, entitled VERTICALLY-STACKED ELECTRONIC DEVICES HAVING CONDUCTIVE CARBON FILMS; 20100283504, entitled METHOD FOR FABRICATION OF A SEMICONDUCTOR ELEMENT AND STRUCTURE THEREOF; 20100279128, entitled Single-Crystalline Metal Nanorings and Methods for Synthesis Thereof; 20100252824, entitled Hybrid Molecular Electronic Devices Containing Molecule-Functionalized Surfaces for Switching, Memory, and Sensor Applications and Methods for Fabricating Same; 20100222536, entitled Method for Functionalizating Carbon Naontubes Utilizing Peroxides; 20100222501, entitled SCALABLE PROCESS FOR SYNTHESIZING UNIFORMLY-SIZED COMPOSITE NANOPARTICLES; 20100209632, entitled Fluorescent Carbon Nanotube Compositions Deposited on Surfaces; 20100186665, entitled Method for low temperature growth of inorganic materials from solution using catalyzed growth and re-growth; 20100151248, entitled Fabrication of light emitting film coated fullerenes and their application for in-vivo emission; 20100143230, entitled METHOD FOR PREPARATION OF NEW SUPERHARD B—C—N MATERIAL AND MATERIAL MADE THEREFROM; 20100139946, entitled SELF-ASSEMBLED NANOPARTICLES-NANOTUBE STRUCTURES BASED ON ANTENNA CHEMISTRY OF CONDUCTIVE NANORODS; 20100133513, entitled NANOPARTICLE/NANOTUBE-BASED NANOELECTRONIC DEVICES AND CHEMICALLY-DIRECTED ASSEMBLY THEREOF; 20100120942, entitled SYNTHESIS OF METAL AND METAL OXIDE NANOPARTICLE-EMBEDDED SILOXANE COMPOSITES; 20100113696, entitled METHODS FOR PREPARING CARBON NANOTUBE/POLYMER COMPOSITES USING FREE RADICAL PRECURSORS; 20100108884, entitled Micromechanical Devices for Materials Characterization; 20100096265, entitled MACROSCOPICALLY MANIPULABLE NANOSCALE DEVICES MADE FROM NANOTUBE ASSEMBLIES; 20100040549, entitled Composition for Targeted Drug Delivery and Controlled Release; 20100035047, entitled METAL AND METAL OXIDE NANOPARTICLE-EMBEDDED COMPOSITES; 20100028680, entitled Nonconcentric nanoshells and methods of making and using same; 20100028247, entitled METHODS FOR SELECTIVE FUNCTIONALIZATION AND SEPARATION OF CARBON NANOTUBES; 20100021367, entitled FACILE PURIFICATION OF CARBON NANOTUBES WITH LIQUID BROMINE AT ROOM TEMPERATURE; 20100008843, entitled MULTI-STEP PURIFICATION OF SINGLE-WALL CARBON NANOTUBES; 20090294753, entitled CARBON NANOTUBE DIAMETER SELECTION BY PRETREATMENT OF METAL CATALYSTS ON SURFACES; 20090269593, entitled FUNCTIONALIZED, HYDROGEN-PASSIVATED SILICON SURFACES; 20090197315, entitled FULLERENE-BASED AMINO ACIDS; 20090173935, entitled PREPARATION OF THIN FILM TRANSISTORS (TFT's) OR RADIO FREQUENCY IDENTIFICATION (RFID) TAGS OR OTHER PRINTABLE ELECTRONICS USING INK-JET PRINTER AND CARBON NANOTUBE INKS; 20090169463, entitled ARRAY OF FULLERENE NANOTUBES; 20090124747, entitled CONDENSATION POLYMERS HAVING COVALENTLY BOUND CARBON NANOTUBES; 20090099276, entitled FUNCTIONALIZED CARBON NANOTUBE-POLYMER COMPOSITES AND INTERACTIONS WITH RADIATION; 20090027069, entitled FUNCTIONALIZED CARBON NANOTUBE-POLYMER COMPOSITES AND INTERACTIONS WITH RADIATION; 20090004094, entitled METHOD FOR CUTTING FULLERENE NANOTUBES; 20080311025, entitled METHOD FOR FORMING A PATTERNED ARRAY OF FULLERENE NANOTUBES; 20080260616, entitled Bulk Separation of Carbon Nanotubes by Bandgap; 20080224100, entitled METHODS FOR PRODUCING COMPOSITES OF FULLERENE NANOTUBES AND COMPOSITIONS THEREOF; 20080213162, entitled Amplification of Carbon Nanotubes Via Seeded-Growth Methods; 20080176212, entitled All optical nanoscale sensor; 20080171204, entitled Fabrication of light emitting film coated fullerenes and their application for in-vivo light emission; 20080169061, entitled INTERAC- TION OF MICROWAVES WITH CARBON NANOTUBES TO FACILITATE MODIFICATION; 20080107586, entitled METHOD FOR PRODUCING A CATALYST SUPPORT AND COMPOSITIONS THEREOF; 20080105648, entitled Carbon nanotube substrates and catalyzed hot stamp for polishing and patterning the substrates; 20080089830, entitled FULLERENE NANOTUBE COMPOSITIONS; 20080063588, entitled METHOD FOR PURIFICATION OF AS-PRODUCED FULLERENE NANOTUBES; 20080063585, entitled FULLERENE NANOTUBE COMPOSITIONS; 20080048364, entitled Polymer/Carbon-Nanotube Interpenetrating Networks and Process for Making Same; 20080014654, entitled Efficient fluorimetric analyzer for single-walled carbon nanotubes; 20070298669, entitled Sidewall Functionalization Of Carbon Nanotubes With Organosilanes For Polymer Composites; 20070297216, entitled SELF-ASSEMBLY OF MOLECULAR DEVICES; 20070280876, entitled Functionalization of Carbon Nanotubes in Acidic Media; 20070259994, entitled Elastomers Reinforced with Carbon Nanotubes; 20070249180, entitled METHOD OF MAKING A MOLECULE-SURFACE INTERFACE; 20070228317, entitled FABRICATION OF REINFORCED COMPOSITE MATERIAL COMPRISING CARBON NANOTUBES, FULLERENES, AND VAPOR-GROWN CARBON FIBERS FOR THERMAL BARRIER MATERIALS, STRUCTURAL CERAMICS, AND MULTIFUNCTIONAL NANOCOMPOSITE CERAMICS; 20070204790, entitled Solvents and new method for the synthesis of cdse semiconductor nanocrystals; 20070118937, entitled Copolymerization and copolymers of aromatic polymers with carbon nanotubes and products made therefrom; 20070110658, entitled Water-soluble single-wall carbon nanotubes as a platform technology for biomedical applications; 20070099792, entitled Carbon nanotube reinforced thermoplastic polymer composites achieved through benzoyl peroxide initiated interfacial bonding to polymer matrices; 20070098620, entitled Method for functionalizing carbon nanotubes utilizing peroxides; 20070071667, entitled Thermal treatment of functionalized carbon nanotubes in solution to effect their functionalization; 20070062411, entitled Fluorescent security ink using carbon nanotubes; 20070048209, entitled Continuous fiber of fullerene nanotubes; 20070043158, entitled Method for producing self-assembled objects comprising fullerene nanotubes and compositions thereof; 20070009421, entitled Fibers comprised of epitaxially grown single-wall carbon nanotubes, and a method for added catalyst and continuous growth at the tip; 20070009417, entitled Supported catalysts using nanoparticles as the support material; 20060269467, entitled Fluorinated nanodiamond as a precursor for solid substrate surface coating using wet chemistry; 20060253942, entitled Smart materials: strain sensing and stress determination by means of nanotube sensing systems, composites, and devices; 20060202168, entitled Functionalized carbon nanotube-polymer composites and interactions with radiation; 20060201880, entitled Length-based liquid-liquid extraction of carbon nanotubes using a phase transfer catalyst; 20060171874, entitled Sidewall functionalization of single-wall carbon nanotubes through C—N bond forming substitutions of fluoronanotubes; 20060166003, entitled Fabrication of carbon nanotube reinforced epoxy polymer composites using functionalized carbon nanotubes; 20060159921, entitled Method to fabricate inhomogeneous particles; 20060159612, entitled Ozonation of carbon nanotubes in fluorocarbons; 20060148272, entitled Fabrication of light emitting film coated fullerenes and their application for in-vivo light emission; 20060139634 Pulsed-multiline excitation for color-blind fluorescence detection; 20060135001, entitled Method for low temperature growth of inorganic materials from solution using catalyzed growth and regrowth; 20060051290, entitled Short carbon nanotubes as adsorption and retention agents; 20050260120, entitled Method for forming an array of single-wall carbon nanotubes in an electric field and compositions thereof; 20050249656, entitled METHOD FOR FORMING A PATTERNED ARRAY OF SINGLE-WALL CARBON NANOTUBES; 20050244326, entitled Method for fractionating single-wall carbon nanotubes; 20050171281, entitled Copolymerization of polybenzazoles and other aromatic polymers with carbon nanotubes; 20050158390, entitled Method to fabricate microcapsules from polymers and charged nanoparticles; 20050129726, entitled Pre-fabricated tissue-engineered plug; 20050089684, entitled Coated fullerenes, composites and dielectrics made therefrom; 20050018274, entitled Nanoparticle-based all-optical sensors; 20040265209, entitled Method for end-derivatizing single-wall carbon nanotubes and for introducing an endohedral group to single-wall carbon nanotubes; 20040223900, entitled Method for functionalizing carbon nanotubes utilizing peroxides; 20040222081, entitled Use of microwaves to crosslink carbon nanotubes; 20040222080, entitled Use of microwaves to crosslink carbon nanotubes to facilitate modification; 20040023479, entitled Method of making a molecule-surface interface; 20040009298, entitled Methods for producing submicron metal line and island arrays; 20030215638, entitled Reduced symmetry nanoparticles; 20030174384, entitled Nanoparticle-based all-optical sensors; 20030106998, entitled Method for producing boron nitride coatings and fibers and compositions thereof; 20030066960, entitled Apparatus for growing continuous single-wall carbon nanotube fiber; 20030010910, entitled Continuous fiber of single-wall carbon nanotubes; 20020159943, entitled Method for forming an array of single-wall carbon nanotubes and compositions thereof; 20020150524, entitled Methods for producing composites of single-wall carbon nanotubes and compositions thereof; 20020136683, entitled Method for forming composites of sub-arrays of single-wall carbon nanotubes; 20020136681, entitled Method for producing a catalyst support and compositions thereof; 20020127169, entitled Method for purification of as-produced single-wall carbon nanotubes; 20020127162, entitled Continuous fiber of single-wall carbon nanotubes; 20020109087, entitled Method for producing a catalyst support and compositions thereof; 20020109086, entitled Method for growing continuous carbon fiber and compositions thereof; 20020102201, entitled Method for forming an array of single-wall carbon nanotubes in an electric field and compositions thereof; 20020102196, entitled Compositions and articles of manufacture; 20020098135, entitled Array of single-wall carbon nanotubes; 20020096634, entitled Method for cutting single-wall carbon nanotubes; 20020094311, entitled Method for cutting nanotubes; 20020092984, entitled Method for purification of as-produced single-wall carbon nanotubes; 20020092983, entitled Method for growing single-wall carbon nanotubes utilizing seed molecules; 20020090331, entitled Method for growing continuous fiber; 20020090330, entitled Method for growing single-wall carbon nanotubes utlizing seed molecules; 20020088938, entitled Method for forming an array of single-wall carbon nanotubes and compositions thereof; 20020085968, entitled Method for producing self-assembled objects comprising single-wall carbon nanotubes and compositions thereof; and 20020084410, entitled Macroscopically manipulable nanoscale devices made from nanotube assemblies, the disclosures of which are incorporated herein in their entireties by reference thereto.

For example, electro-thermal nanotubes may be held in suspension within a urethane base. The electro-thermal nanotubes may be microscopic fibers of carbon that may conduct electricity, convert electricity into thermal energy, and are very durable. When energized, the nanotubes may act as resistive heating elements that heat up as electrical energy flows through, and may increase in temperature as the electrical energy increases, thereby, the nanotube coating may function as a radiant heat source. The electro-thermal nanotubes may work with either alternating current (AC) or direct current (DC) electrical sources and temperature control may be achieved using off the shelf technology. A nanotube/urethane composite may be used as a spray on thermal coating that may convert a surface, on to which the composite is sprayed, into a radiant heat source.

While composite heating elements including carbon nanotubes are described herein in conjunction with water heaters, the composite heating elements may be incorporated into numerous applications (e.g., heating asphalt, heating concrete, heating airplane wings and fuselages, heated garments, air heating, heating batteries, heated food containers, heated drink containers, etc.). In fact, the composite heating elements of the present disclosure may generally be incorporated in any convection, conduction or radiant heating application.

Figure 1B:
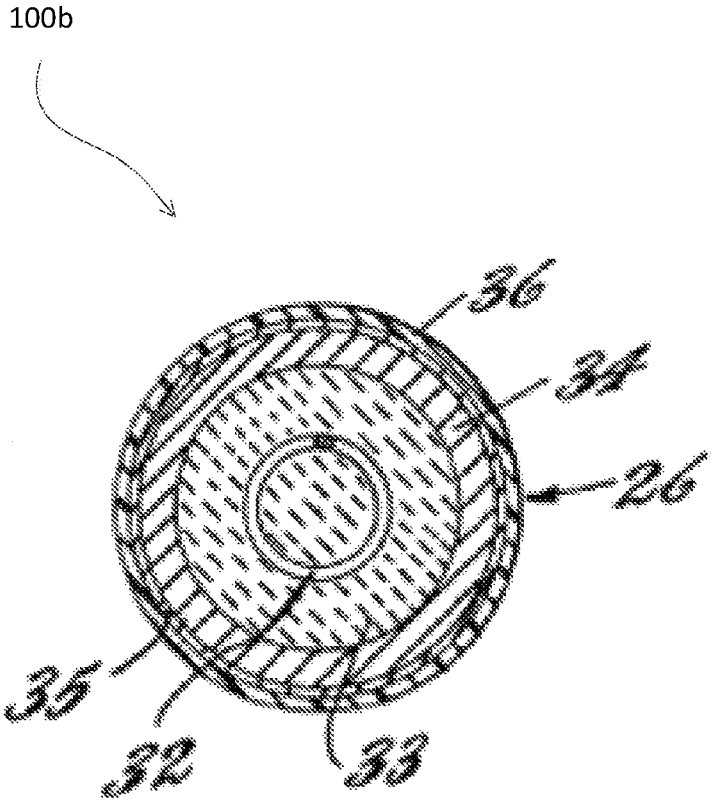

With reference to FIGS. 1A and 1B, a water heater may include a tank 1 formed of a generally cylindrical shell which may be enclosed at the ends by suitable heads. Cold water to be heated may be introduced into tank 1 through an inlet 2 and heated water is withdrawn through the tank through outlet 3. The tank 1 may be housed within a generally cylindrical casing 4 which may be spaced outwardly from the tank and a suitable insulating material 5 is disposed in the clearance between the tank 1 and casing 4.

Water within tank 1 may be heated by a flexible, wrap-around heating element 6 which may be disposed around an outer surface of tank 1 and may be in heat conductive relation with the tank. The wrap-around heating element 6 may be disposed around a pipe in lieu of, or addition to, the tank 1. Ends of the heating element 6 may be connected together by a spring connection which may include a plurality of spring clips 7. Two of the clips 7 may be secured to each end of the heating element 6. The heating element 6 may include carbon nanotubes. The corresponding spring clips 7 may be secured together by bolts 8 and by threaded adjustment of the bolts, the tension of the heating element around the tank can be varied. The threaded position of the bolts 3 in spring clips 7 may be maintained by means of nuts 9 which are threaded on the ends of the bolts. The resilient connection between the ends of the heating element 6 permits the element to freely expand and contract during heating and cooling and tends to maintain the element: in tight bearing relation with the tank at all times.

Each end of the heating element 6 is provided with an electrical contact 10 and leads 11 connect the contacts to the thermostat 12 which is secured to the tank 1 at a position located above the heating element 6. The heating element 6 is housed within a generally channel-shaped casing 13. The open side of the channel-shaped casing 13 faces the tank and the flanges of the casing bear against the tank wall on opposite sides of the heating element 6. The casing 13 not only serves to house and protect the heating element in service but also functions as a guide track through which the heating element is inserted around the tank.

The ends of the casing 13 are connected together by a pair of coil springs 14 which serve to urge the casing into tight bearing engagement with the tank wall. In the commercial manufacture of water heaters, the steel of which the tank 1 is fabricated is initially cleaned of mill scale and other impurities by sandblasting or the like. This cleaning treatment tends to leave the outer surface of the tank in a somewhat roughened condition and due to the roughened condition, the heating element 6 is not always able to move freely on the tank wall during expansion and contraction.

A strip or band of glass or vitreous enamel is applied to a circumferential portion of the outer surface of the tank wall and the heating element 6 may be positioned over this glass strip 15. While the glass coating is in itself an insulating material it provides a smooth surface and enables the heating element to freely adjust itself during expansion and contraction and thereby eliminates the possibility of "hot spots" being formed on the heating element. In effect, the glass coating 15 may increase heat transfer from the heating element to the tank 1 due to the fact that the heating element can move freely on the tank wall.

In addition to the glass strip 15, the entire inner surface of the tank 1 may be coated with a glass or vitreous coating 16 and the coatings 15 and 16 can be fired and fused to the tank during the same firing operation. In assembly of the water heater of the invention the upper head of the tank is welded to the cylindrical shell and the inner surface of the shell and head are coated with a glass slip. At this time a band or strip on the outside of the tank is also coated with the glass slip by dipping, spraying, brushing or the like. The coated shell and upper head are then fired at an elevated temperature of 1600° to 1800° F. to fuse the glass coatings to the tank wall. A glass coated lower head is then assembled in the lower end of the shell to complete the tank assembly.

The casing 13 is then secured around the tank at a position over the glass coating 15 by means of the springs 14. One end of the heating element 6 is then inserted within the passage defined by the casing and the tank wall and passed through the casing. The ends of the heating element are then connected together by means of the spring clips 7 and bolts 8.

Figure 2A:
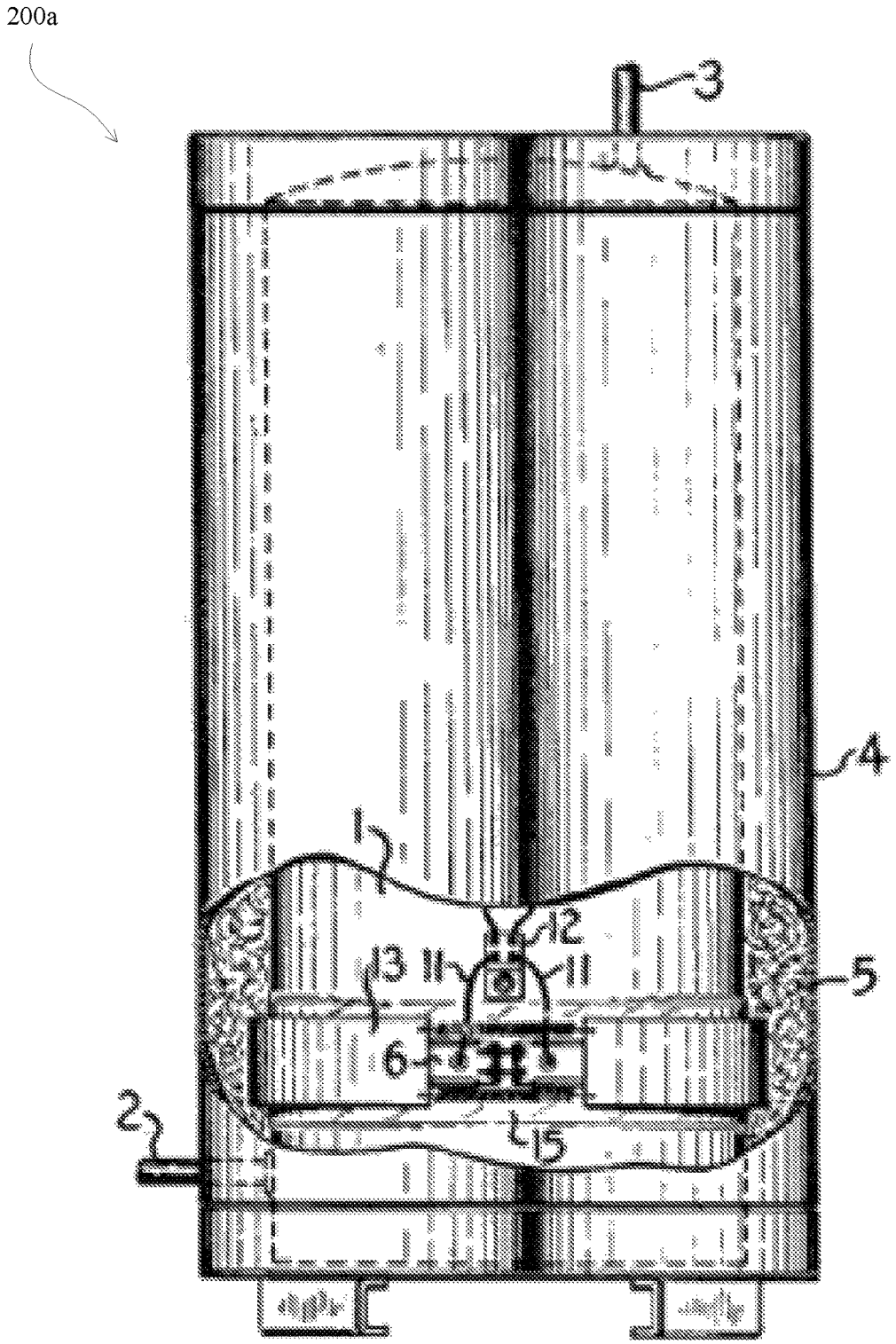
FIGS. 2A-2C depict an example water heating element.
Figure 2B:
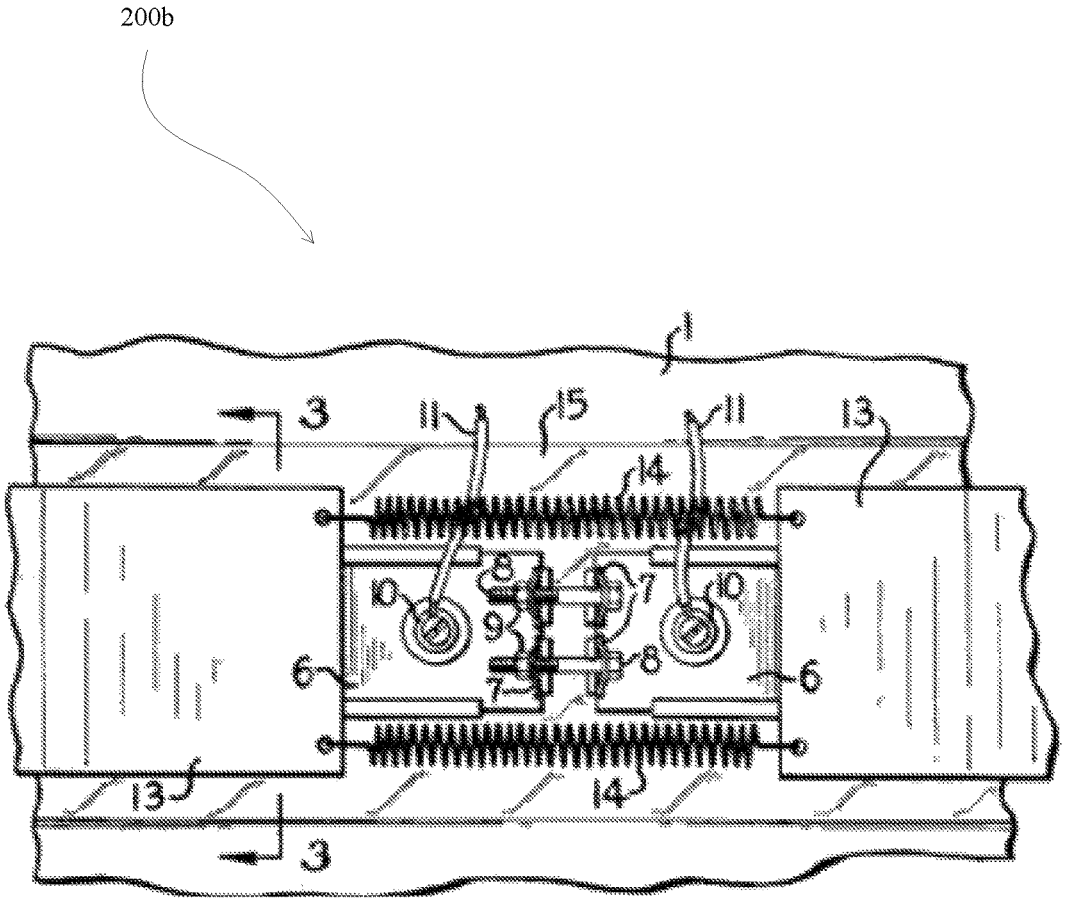
Figure 2C:
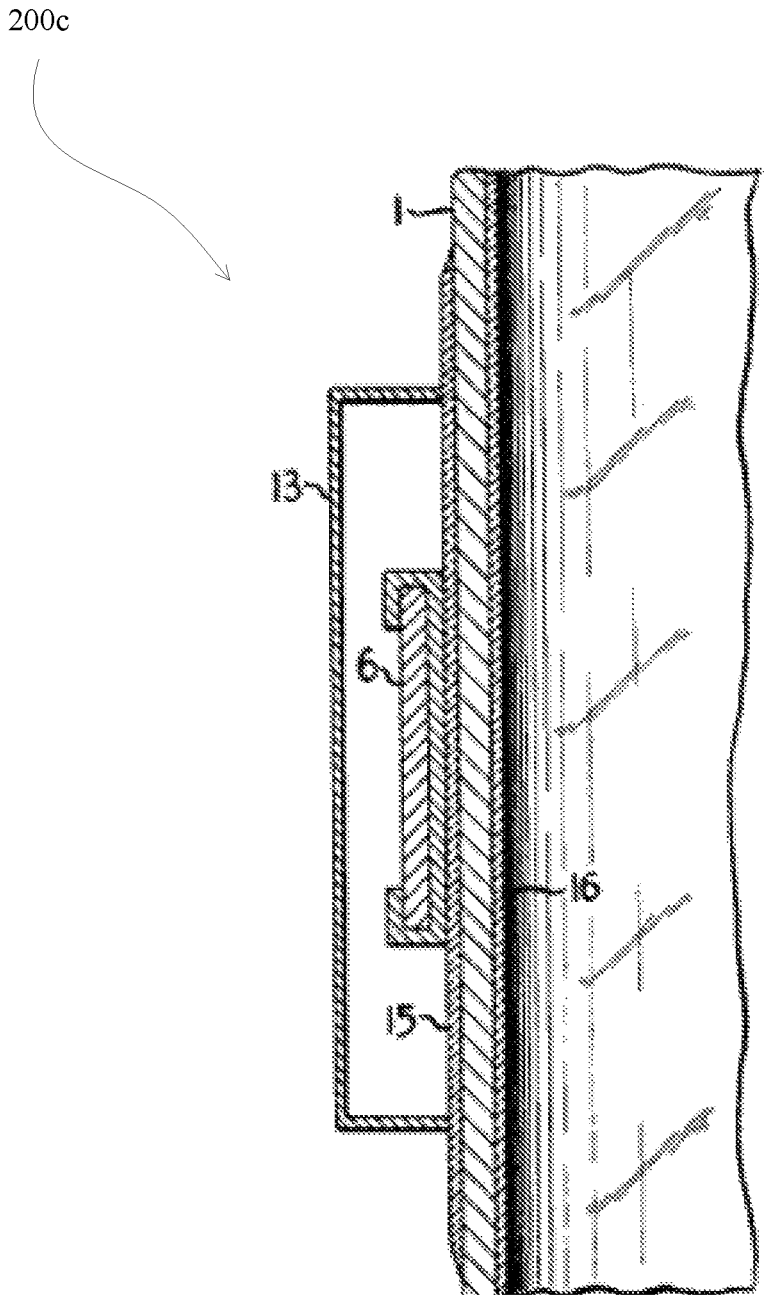

Turning to FIGS. 2A-2C, a conventional electrical water heater 20 consisting of a tank 21, which will suitably be internally glass lined (not shown) or otherwise coated for protection on the inside. The tank contains an inlet connection 22, conveniently located at the bottom and an outlet connection 23, suitably at the top. A sacrificial anode 24 is removably inserted as by a threaded connection at 25. The anode 24 will conveniently consist of magnesium, zinc or the like.

A looped electrical resistance heater element 26 extends into the tank, and is mounted on a suitable removable base 27 provided with an insulating support 28 and having electrical connections 30 and 31. As best seen in FIG. 2B, the electrical resistance heater 26 desirably consists of an interior heating element or resistor 32 suitably of nichrome or other resistance wire, protected by a surrounding insulating layer 33, suitably magnesia or other refractory powder, surrounded by a copper sheath 34 as well known in the art. According to the present invention a nickel layer 35 surrounds the copper and then a polytetrafluoroethylene layer 36 according to present invention forms a barrier between the copper layer and the water. The interior 37 of the tank will suitably be filled with water, not shown.

EXAMPLE 1

Three 1500-watt copper sheathed heating elements were prepared for application of the polytetrafluoroethylene coating by first conventionally nickel plating them to a thickness averaging approximately 1 mil, lightly sand blasting, heating and allowing them to cool to room temperature as previously described. The elements were then each coated with two successive coatings comprising poly-tetrafluoroethylene aqueous dispersion, suitably a primer coat and a top coat, each separately applied and fused in the manner previously described.

The two coating materials used were those commercially available from E.I. du Pont de Nemours & Co. under the designations 851-204 "Teflon" TFE-Fluorocarbon Resin One Coat Green Enamel (primer coat) and 851-205 "Teflon" TFE-Fluorocarbon Resin Black Enamel (second coat). The Du Pont 851-204 product is composed of about 48% of polytetrafluoroethylene resin soluble by weight in a water medium and the 851-205 product is composed of about 41% polytetrafluoroethylene solids by weight in a water medium, each containing a nonionic wetting agent as above set forth and a few percent of pigment which is optional. The dispersion was applied as a spray to the heating elements, which were supported by the terminal ends, the primer being coated to a thickness of about ¾ mil and the second coat to a thickness of about 1 mil. After fusing, the primer coat had a thickness which ranged from 0.1 mil to about 1 mil and aver-aged about 0.35 mil. The second coat after fusing had a thickness which ranged from about 0.1 mil to about 1 mil and averaged about 0.43 mil.

The coated electrodes were energized at rated voltage of 236 volts and subjected to 3,000 heating cycles. Each heating cycle consisted of 15 minutes with elements energized and 20 minutes with the elements de-energized. The water temperature ranged from 165° F. to 180° F.

The resistances of the coating in ohms on the respective electrodes before test were 50,000, 60,000 and 70,000 ohms. After test the resistances of the coating in ohms were 30,000, 40,000 and 30,000 ohms. One of the elements was then energized at 360 volts (an over-voltage).

This gave a watt density of 300 watts per square inch as compared to a normal watt density of 140 watts per square inch. The element was subjected to 136 cycles, consisting of 15 minutes energized and 30 minutes deenergized.

Figure 3:
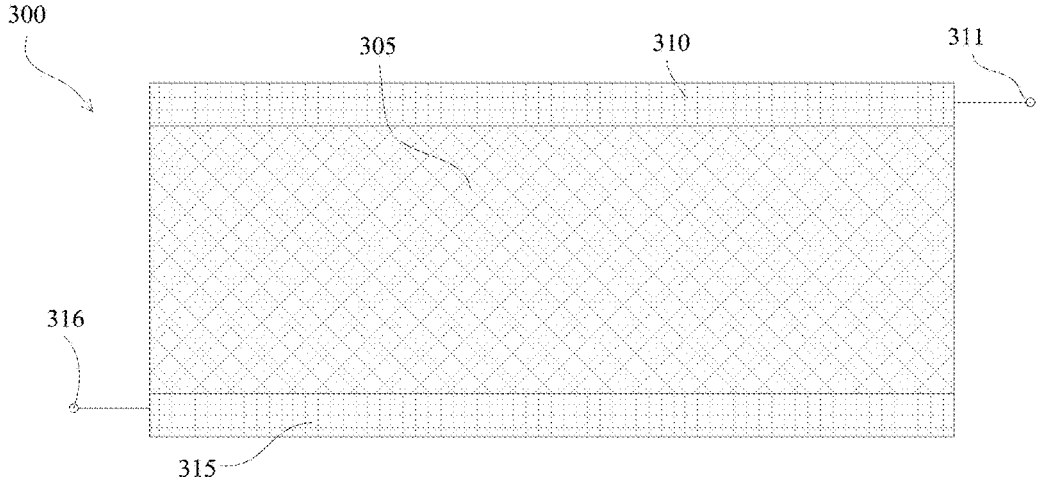
FIG. 3 depicts a plan view of an example nanoparticle composite heater.

With referenced to FIG. 3, a nanoparticle composite heating element 300 may include a nanoparticle composite 305 including a first electrode 310 having an activation connection 311, and a second electrode 315 having a negative connection 312. The nanoparticle composite 305 may include a nanometer-scale tube-like structure (e.g., BCN nanotube, ~BCN nanotube, ~BC2N nanotube, boron nitride nanotube, carbon nanotube, DNA nanotube, gallium nitride nanotube, silicon nanotube, inorganic nanotube, tungsten disulphide nanotube, membrane nanotube having a tubular membrane connection between cells, titania nanotubes, tungsten sulfide nanotubes, etc.). The nanoparticle heating element 300 may be similar to, for example, the nanoparticle composite heating elements 22*a-f* of FIG. 1, or the nanoparticle composite heating elements 22*a-f* of FIG. 2B.

Figure 4:
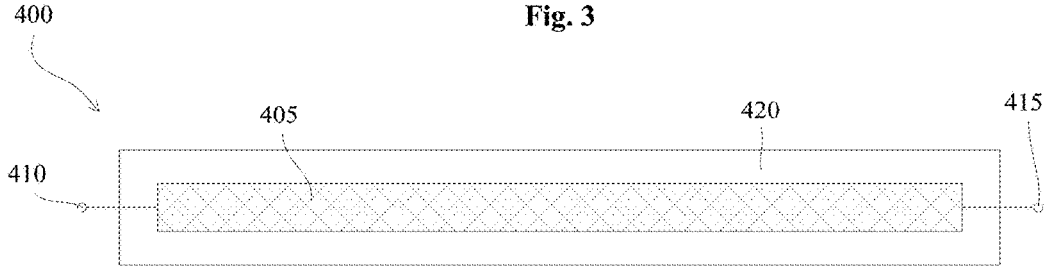
FIG. 4 depicts a profile view of an example nanoparticle composite heater encapsulated within an inert material.

Turning to FIG. 4, a heating element 400 may include a nanoparticle composite heater 405 encapsulated within an inert material 420 (e.g., glass, silicon, porcelain, etc). The nanoparticle heater 405 may be similar to, for example, the nanoparticle composite heating elements 22*a-f* of FIG. 1, the nanoparticle composite heating element 22*a-f* of FIG. 2, or the nanoparticle composite heating element 300 of FIG. 3. The heating element 400 may also include an activation terminal 410 and a negative terminal 415.

Figure 5:
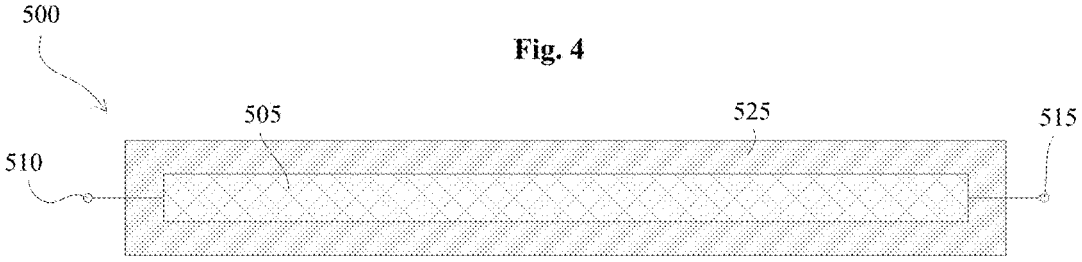
FIG. 5 depicts a profile view of an example nanoparticle composite heater encapsulated within a thermally conductive material.

With reference to FIG. 5, an element 500 may include a nanoparticle composite heater 505 encapsulated within a thermally conductive material 525 (e.g., metal, tin, copper, glass, silicon, porcelain, etc). The nanoparticle heater 505 may be similar to, for example, the nanoparticle composite heating elements 22*a-f* of FIG. 1, the nanoparticle composite heating elements 22*a-f* of FIG. 2, the nanoparticle composite heating element 300 of FIG. 3, or the nanoparticle heater 400 of FIG. 4. The heating element 500 may also include an activation terminal 510 and a negative terminal 515.

Figure 6:
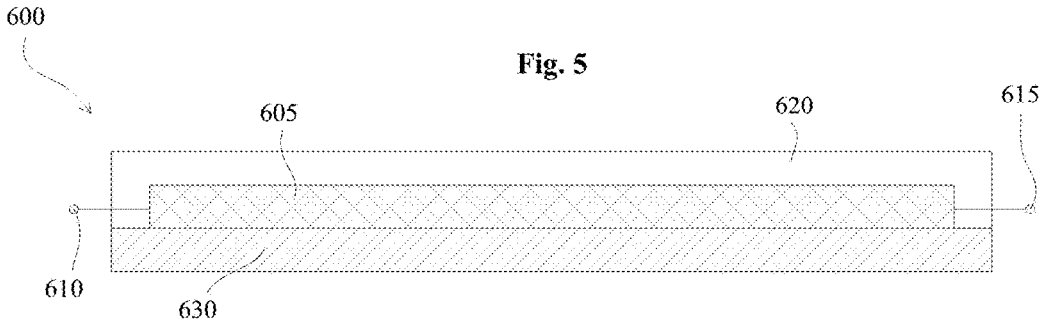
FIG. 6 depicts a profile view of an example nanoparticle composite heater encapsulated within an inert material and a thermally insulating material.

Turning to FIG. 6, an element 600 may include a nanoparticle composite heater 605 encapsulated within an inert material 620 and a thermally insulating material 630. The nanoparticle heater 605 may be similar to, for example, the nanoparticle composite heating elements 22*a-f* of FIG. 1, the nanoparticle composite heating elements 22*a-f* of FIG. 2, the nanoparticle composite heating element 300 of FIG. 3, the nanoparticle heater 400 of FIG. 4, or the nanoparticle heater 505 of FIG. 5. The heating element 600 may also include an activation terminal 610 and a negative terminal 615.

The thermally insulating material 630 may be fiberglass, mineral wool, cellulose, polyurethane foam, polystyrene, aerogel (used by NASA for the construction of heat resistant tiles, capable of withstanding heat up to approximately 2000 degrees Fahrenheit with little or no heat transfer), natural fibers (e.g., hemp, sheep's wool, cotton, straw, etc.), polyisocyanurate, or polyurethane.

A heating element 6, 26, 300, 400, 500, 600 may include sidewall-functionalized carbon nanotubes. The functionalized carbon nanotubes may include hydroxyl-terminated moieties covalently attached to their sidewalls. Methods of forming the functionalized carbon nanotubes may involve chemistry on carbon nanotubes that have first been fluorinated. In some embodiments, fluorinated carbon nanotubes ("fluoronanotubes") may be reacted with mono-metal salts of a dialcohol, MO—R—OH. M may be a metal and R may be a hydrocarbon or other organic chain and/or ring structural unit. In such embodiments, —O—R—OH may displace —F on the associated nanotube, the fluorine may leave as MF. Generally, such mono-metal salts may be formed in situ by addition of MOH to one or more dialcohols in which the fluoronanotubes have been dispersed. Fluoronanotubes may be reacted with amino alcohols, such as being of the type H2N—R—OH, wherein —N(H)—R—OH displaces —F on the nanotube, the fluorine may leave as HF.

A heating element 6, 26, 300, 400, 500, 600 may include carbon nanotubes integrated into an epoxy polymer composite via, for example, chemical functionalization of the carbon nanotubes. Integration of the carbon nanotubes into an epoxy polymer may be enhanced through dispersion and/or covalent bonding with an epoxy matrix during a curing process. In general, attachment of chemical moieties (i.e., functional groups) to a sidewall and/or end-cap of carbon nanotubes such that the chemical moieties may react with either epoxy precursor, a curing agent, or both during the curing process. Additionally, chemical moieties can function to facilitate dispersion of carbon nanotubes with an epoxy matrix by decreasing van der Waals attractive forces between the nanotubes.

A heating element 6, 26, 300, 400, 500, 600 may include a carbon nanotube carpet that may include a resistance of a nanotube, and/or the nanotube carpet, of between about 0.1 kΩ and about 10.0 kΩ. Instead, the resistance of a nanotube may be between about 2.0 kΩ and about 8.0 kΩ. As an another alternative, the resistance of a nanotube may be between about 3.0 kΩ and about 7.0 kΩ. A conductive layer/contact may include single or dual damascene copper interconnects, poly-silicon interconnects, silicides, nitrides, and refractory metal interconnects such as, but not limited to, Al, Ti, Ta, Ru, W, Nb, Zr, Hf, Ir, La, Ni, Co, Au, Pt, Rh, Mo, and their combinations. An insulating material or materials may be coated onto individual tubes and/or bundles of tubes (nanotubes) to isolate the tubes and/or bundles from a conductive material. An insulating material may completely cover the tubes and/or bundles. Alternatively, gaps or other discontinuities may be included in the insulating material such that the nanotubes and/or bundles of nanotubes are not completely covered. The insulating material may include polymeric, oxide materials, and/or the like.

A heating element 6, 26, 300, 400, 500, 600 may be at least partially formed on a liquid and/or gas heater tank and/or associated piping by spraying a carbon nanotube/epoxy solution onto a fabric as described herein and within the patents and patent applications that are incorporated herein by reference. The resulting heating element 6, 26, 300, 400, 500, 600 may be on an outside of the tank and/or piping, an inside surface of the tank and/or piping, or may be sandwiched between two or more pieces of the tank and/or piping.

Although exemplary embodiments of the invention have been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A water heating element, comprising:

a carbon nanotube composite;

a positive electrical connection and a negative electrical connection, wherein the positive electrical connection and the negative electrical connection are configured to connect the carbon nanotube composite to an electric power source; and a corrosion protective anode, for reducing deterioration of the anode and adapted to extend into the tank of the water heater, comprising a looped electric resistor, a resistor electric insulating layer surrounding said electric resistor, a metallic sheath surrounding said resistor insulating layer, said sheath having an exterior surface of nickel, a sheath electric insulating layer of polytetrafluoroethylene covering said nickel surface and adhering thereto, electric connections to the two ends of the electric resistor, and an insulating support for the electric connections.

2. The water heating element of claim 1, configured to heat a tank that contains water to be heated and having a cold water inlet and a hot water outlet therein, a coating of glass fused to an outer surface of the tank and extending continuously around the tank, wherein the wrap-around water heating element is a flexible metallic wrap-around heating element disposed on said glass coating and extending substantially around the tank.

3. The water heating element of claim 2, further comprising:

a resilient connection connecting the ends of the element together and serving to bias the element around the tank, said glass coating providing a smooth surface to thereby permit the heating element to freely move thereon during expansion and contraction of the element due to alternate heating and cooling.

4. The water heating element of claim 1, in which said sheath is of copper, having an exterior layer of nickel plated thereon.

5. The water heating element of claim 4, in which the exterior surface of said nickel surface has a matte finish.

6. A water heating element, comprising:

a carbon nanotube composite;

a positive electrical connection and a negative electrical connection, wherein the positive electrical connection and the negative electrical connection are configured to connect the carbon nanotube composite to an electric power source; and a corrosion protective anode, for reducing deterioration of the anode and adapted to extend into the tank of the water heater, comprising a looped electric resistor, a resistor electric insulating layer surrounding said electric resistor, a metallic sheath surrounding said resistor insulating layer, said sheath having an exterior surface of nickel, a sheath electric insulating layer of polytetrafluoroethylene covering said nickel surface and adhering thereto, electric connections to the two ends of the electric resistor, and an insulating support for the electric connections, wherein the exterior surface of said nickel surface has a coating of nickel oxide.

7. The water heating element of claim 6, in which said sheath is of copper, having an exterior layer of nickel plated thereon.

8. The water heating element of claim 7, in which the external surface of said nickel coating has a matte finish.

9. A water heating element comprising:

a carbon nanotube composite;

a positive electrical connection and a negative electrical connection, wherein the positive electrical connection and the negative electrical connection are configured to connect the carbon nanotube composite to an electric power source; and a corrosion protective anode, for reducing deterioration of the anode and adapted to extend into the tank of the water heater, comprising a looped electric resistor, a resistor electric insulating layer surrounding said electric resistor, a metallic sheath surrounding said resistor insulating layer, said sheath having an exterior surface of nickel, a sheath electric insulating layer of polytetrafluoroethylene covering said nickel surface and adhering thereto, electric connections to the two ends of the electric resistor, and an insulating support for the electric connections, wherein the exterior surface of said nickel surface has a matte finish.

10. The water heating element of claim 9, in which said sheath is of copper, having an exterior layer of nickel plated thereon.

11. The water heating element of claim 9, in which the exterior surface of said nickel surface has a coating of nickel oxide.

12. The water heating element of claim 10, in which the external surface of said nickel coating has a matte finish.

13. The water heating element of claim 10, in which the external surface of said nickel coating has a coating of nickel oxide.

* * * * *